US007631465B2

(12) United States Patent
Curtis

(10) Patent No.: US 7,631,465 B2
(45) Date of Patent: Dec. 15, 2009

(54) JAMB ADJUSTMENT AND SECUREMENT ASSEMBLY AND METHODS THEREFOR

(75) Inventor: Daniel J. Curtis, Warroad, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 687 days.

(21) Appl. No.: 11/127,906

(22) Filed: May 12, 2005

(65) Prior Publication Data

US 2006/0272234 A1 Dec. 7, 2006

(51) Int. Cl.
*E06B 1/04* (2006.01)
*E06B 3/00* (2006.01)

(52) U.S. Cl. ..... 52/204.1; 52/204.5

(58) Field of Classification Search ..... 52/204.1, 52/211, 212, 213, 214, 204.5, 204.51, 205.55, 52/204.66, 204.65, 204.7, 204.72
See application file for complete search history.

(56) References Cited

U.S. PATENT DOCUMENTS

| | | | | |
|---|---|---|---|---|
| 926,735 | A | 7/1909 | Gould | |
| 1,038,160 | A | 9/1912 | Leonard | |
| 1,842,242 | A | 1/1932 | Bolles | |
| 2,593,239 | A | 4/1952 | Anderson | |
| 2,595,419 | A | 5/1952 | Smith | |
| 2,843,233 | A | 7/1958 | Walsh | |
| 2,912,077 | A | 11/1959 | Walsh | |
| 2,943,345 | A | 7/1960 | Ammerman | |
| 3,145,433 | A | 8/1964 | Jones | |
| 3,676,956 | A | 7/1972 | Taylor et al. | |
| 3,717,887 | A | 2/1973 | Thomas | |
| 3,724,136 | A | 4/1973 | Forsberg | |
| 4,014,146 | A | 3/1977 | DiMascio et al. | |
| 4,300,316 | A | 11/1981 | Ficurilli | |
| 4,397,124 | A | 8/1983 | Redman | |
| 4,441,277 | A * | 4/1984 | Naylor | 49/380 |
| 4,478,016 | A | 10/1984 | Allen | |
| 4,551,881 | A | 11/1985 | Hoffman | |
| 4,570,382 | A | 2/1986 | Suess | |

(Continued)

FOREIGN PATENT DOCUMENTS

| | | |
|---|---|---|
| AU | 0220004 | 5/1958 |

(Continued)

OTHER PUBLICATIONS

"U.S. Appl. No. 11/127,985, Preliminary Amendment and Response filed Jun. 12, 2008 to Restriction Requirement mailed May 12, 2008", 10 pages.

(Continued)

*Primary Examiner*—Richard E Chilcot, Jr.
*Assistant Examiner*—Jessica Laux
(74) *Attorney, Agent, or Firm*—Schwegman, Lundberg & Woessner, P.A.

(57) ABSTRACT

Assemblies and methods for positioning and securing a window or door unit within a rough opening of a building or other structure. In one example, the assembly includes a jamb member and a jamb liner coupled with the jamb member. The jamb liner includes a retaining member sized and shaped to receive and engage a fastener at a plurality of locations therein. In another example, the retaining member includes at least one flange to engage the fastener and a groove to seat a fastener head.

22 Claims, 9 Drawing Sheets

U.S. PATENT DOCUMENTS 4,583,639 A 4/1986 Fedick et al.
4,606,147 A 8/1986 DeWitt et al.
4,685,175 A 8/1987 Yonovich
4,698,944 A 10/1987 Wilkins, Jr.
4,719,729 A * 1/1988 Wynar ..... 52/211
4,726,148 A 2/1988 Tix
4,763,447 A 8/1988 Haltof et al.
4,799,333 A 1/1989 Westfall et al.
4,885,871 A 12/1989 Westfall et al.
4,891,921 A 1/1990 Governale
4,914,861 A 4/1990 May
4,922,657 A 5/1990 Foss
5,012,554 A 5/1991 Dense
5,027,557 A 7/1991 May
5,033,235 A 7/1991 Stark
5,036,622 A 8/1991 Stark
5,038,538 A * 8/1991 Rozon ..... 52/213
5,099,624 A 3/1992 Valentin
5,117,586 A 6/1992 Stark
5,167,073 A 12/1992 Stein
5,174,064 A 12/1992 Stark
5,174,703 A 12/1992 White
5,199,219 A 4/1993 Martini et al.
5,224,298 A 7/1993 Horst
5,231,795 A 8/1993 Westfall
5,265,308 A 11/1993 May et al.
5,293,723 A * 3/1994 Slessor ..... 52/213
5,414,962 A 5/1995 Forbis et al.
5,448,857 A 9/1995 Stormo
5,515,652 A 5/1996 Klimek
5,526,608 A 6/1996 Stark
5,544,450 A 8/1996 Schmidt et al.
5,546,702 A 8/1996 deNormand et al.
5,566,507 A 10/1996 Schmidt et al.
5,632,118 A 5/1997 Stark
5,671,566 A 9/1997 Tix et al.
5,675,937 A 10/1997 Stebel
5,698,944 A * 12/1997 Togawa ..... 313/582
5,699,636 A 12/1997 Start
5,703,720 A 12/1997 Fulco et al.
5,866,054 A 2/1999 Dorchester et al.
5,901,499 A 5/1999 Delaske et al.
5,934,031 A 8/1999 deNormand
5,974,745 A 11/1999 Barr
6,018,916 A 2/2000 Henry
6,026,617 A 2/2000 Stark
6,041,475 A 3/2000 Nidelkoff
6,041,550 A 3/2000 Tix
6,055,782 A 5/2000 Morton et al.
6,112,463 A 9/2000 Reithmeyer et al.
6,119,324 A 9/2000 Suess
6,122,864 A 9/2000 Martin
6,141,913 A 11/2000 Wong et al.
6,167,655 B1 1/2001 Santa Cruz et al.
6,279,270 B1 8/2001 Suess
6,282,852 B1 9/2001 Walcker
6,293,061 B1 9/2001 Horak, Jr.
6,305,126 B1 10/2001 Hendrickson et al.
6,308,487 B1 10/2001 Cantley
6,357,200 B1 3/2002 Vanderpan
6,405,501 B1 6/2002 Cerrato
6,470,643 B1 10/2002 Cantley
6,530,190 B2 3/2003 Conachen
6,588,150 B1 7/2003 Wong et al.
6,588,159 B1 7/2003 Cotton, Jr.
6,684,571 B2 2/2004 Hendrickson et al.
6,718,693 B2 4/2004 Gleason
6,722,082 B1 4/2004 Peterson et al.
6,826,878 B1 12/2004 Rovtar
6,883,276 B1 4/2005 Hannan et al.
7,228,660 B2 6/2007 Rhode et al.
7,340,866 B1 * 3/2008 Smith ..... 52/204.54
7,416,772 B2 * 8/2008 Rinehart et al. ..... 428/99
7,552,562 B2 6/2009 Curtis
2003/0024182 A1 * 2/2003 Yeany ..... 52/204.67

FOREIGN PATENT DOCUMENTS

CA 0605391 9/1960

OTHER PUBLICATIONS

"U.S. Appl. No. 11/127,985 Amendment and Response filed Nov. 10, 2008 to Non-Final Office Action mailed Aug. 8, 2008", 11 pgs.
"U.S. Appl. No. 11/127,985 Non-Final Office Action mailed Aug. 8, 2008", 9 pgs.
"U.S. Appl. No. 11/127,985, Reestriction Requirement mailed May 12, 2008", 6 pgs.
"U.S. Appl. No. 11/127,985, Notice of Allowance mailed Feb. 25, 2009", 9 pgs.

* cited by examiner

JAMB ADJUSTMENT AND SECUREMENT ASSEMBLY AND METHODS THEREFOR

CROSS-REFERENCE TO RELATED APPLICATION

This patent document is related to the U.S. patent application titled "STRUCTURAL FILLER SYSTEM FOR A WINDOW OR DOOR," Ser. No. 11/127,985, filed on May 12, 2005, which is hereby incorporated by reference in its entirety.

TECHNICAL FIELD

This patent document pertains generally to the mounting of a window or door unit within a rough opening of a building or other structure. More particularly, but not by way of limitation, this patent document pertains to a jamb adjustment and securement assembly and methods therefor.

BACKGROUND

In the construction of buildings and other structures, prefabricated windows and doors are often installed in wall (rough) openings, which are provided for by a contractor according to architectural specifications. Typically, a rough opening is bounded by a header (along the top) that is supported by jack studs (e.g., wooden studs) on each side, and a sill (along the bottom).

The installation of jack studs ordinarily takes place early in the construction process and without time-consuming measuring, plumbing or trueing operations. As a result, the perimeter of rough structural openings usually does not comprise a true rectangle or square, and the sides of each opening are commonly not plumb. Further, the dimensions of the rough openings vary substantially so that it is rarely possible to attach one or more window or door frame members (e.g., head jamb, side jambs, or sill) directly to corresponding rough opening members (e.g., header, jack studs, or sill) and provide a serviceable opening which will precisely receive a window, door or other closure.

Therefore, in order to produce a properly sized, plumb opening such as a window-way or doorway, it is necessary to dispose each of the window or door frame members in a proper position with respect to one another, regardless of their relationship to members of the rough opening. To achieve this result, the gaps between the (window or door) framing members and the rough opening are typically filled with one or a combination of shims or other similar spacers. Shims are often tapered wooden members, such as wooden shingles, which afford an installer a measure of adjustability.

A great deal of the cost in installing windows and doors is attributable to labor. A large portion of this cost stems from the generation of shim combinations which must be painstakingly fitted between the (window or door) framing members and adjacent members of the rough opening until it is found that the frame is plumb, with opposing frame members at predetermined distances from one another. Even a skilled installer (e.g., carpenter) requires a fair amount of time to install a window or door frame in a rough opening due, in large part, to the necessity of locating and placing shims to establish a plumb window or door orientation.

What is needed is a window and door assembly and method, which increases the speed and accuracy of a window or door installation. What is further needed is a window and door assembly and method that allows less experienced persons (as compared to a skilled carpenter) to properly install a window or door unit.

SUMMARY

A window or door assembly for receiving a fastener includes a jamb member and a jamb liner coupled with the jamb member. The jamb liner includes a retaining member sized and shaped to receive and engage the fastener therein, thereby allowing a (window or door) frame to be positioned from, and secured to, a rough opening in a wall of a building or other structure by simple rotation of the fastener. The retaining member includes at least one flange that longitudinally extends along a portion of the jamb member and a groove formed, in part, therefrom. In varying examples, the at least one flange includes both an entry portion and an engagement portion. The entry portion is sized and shaped to urge the fastener into the retaining member, while the engagement portion is sized and shaped to retain the fastener within the retaining member after a fastener head is seated in the groove.

Several options for the window or door assembly are as follows. In one example, the retaining member longitudinally extends along a substantial portion of the jamb member. In another example, the retaining member longitudinally extends along an entire portion of the jamb member, thereby allowing an installer to place one or more fasteners anywhere along the full length of the jamb member. In another example, the retaining member is extruded with the jamb liner. In yet another example, the jamb member and the jamb liner are integral. Other options are as follows. In one example, the retaining member is formed of a resilient material to allow the fastener to pass by the at least one flange and be subsequently held in place (e.g., retained) by the same. In another example, the retaining member is formed of a material selected from a group consisting of a metal and a polymer.

A method for manufacturing a window or door assembly includes, forming a longitudinally extending retaining member sized and shaped to receive and engage a fastener at a plurality of locations therein. The retaining member includes at least one flange and a groove within the at least one flange. The method further includes coupling the retaining member with a jamb liner. Further yet, the method includes coupling the retaining member and jamb liner with a jamb member. Several options for manufacturing the window or door assembly are as follows. In one example, forming the at least one flange includes forming an entry portion sized and shaped to facilitate insertion of the fastener into the retaining member. In another example, forming the at least one flange includes forming an engagement portion sized and shaped to overlap a top surface of a fastener head when the fastener head is fully seated in the groove. In yet another example, forming the groove includes forming a shape sized to matably seat the fastener head when the top surface of the fastener head advances past the engagement portion of the at least one flange. In a further example, coupling the retaining member includes extruding the retaining member with the jamb liner.

A method for installing a window or door assembly (such as the assembly described above) includes placing a jamb member within a rough opening in a wall such that the jamb member is positioned adjacent to an inner surface of the rough opening. At least one fastener is driven into the jamb member (and thus a jamb liner) thereby engaging a top surface of a fastener head with at least one flange of a retaining member. The method further includes adjusting a position of the jamb member relative to the inner surface of the rough opening and securing the jamb member to the inner surface of the rough opening.

Several options for adjusting the position of the jamb member are as follows. In one example, adjusting the position of the jamb member includes selectively rotating the at least one fastener in a clockwise or a counterclockwise direction. In one such example, rotation of the at least one fastener in a clockwise direction affects movement of the jamb member in a direction of the inner surface of the rough opening, while rotation of the at least one fastener in a counterclockwise direction affects movement of the jamb member away from the inner surface of the rough opening. In another example, adjusting the position of the jamb member includes positioning the jamb member until a plumb and square orientation is achieved. In yet another example, adjusting the position of the jamb member includes removing one or more bows from the jamb member. Other options are as follows. In one example, the method further comprises inserting one or more spacers between the jamb member and the inner surface of the rough opening. In one such example, one or a combination of shims is inserted between the jamb member and the inner surface of the rough opening.

The present assemblies and methods provide numerous advantages for an installer. As one example, the present assemblies and methods provide a (window or door) frame mounting scheme that does not rely on the use of spacers, such as shims, for proper positioning of the frame (e.g., head jamb, side jambs, or sill) within a rough opening in a wall. Rather the present assemblies and methods allow for adjustably positioning the frame within the rough opening by simple rotation of at least one fastener engaged with a retaining member, thereby saving the installer time and effort. This shim-less adjusting also simplifies the installation process allowing a novice (in the field of carpentry) to install a window or door with minimal difficulty. It is only after the window or door is properly positioned within the rough opening that one or more spacers may need to be inserted between adjacent frame and rough opening members. The insertion of the one or more spacers at such a stage in the installation process may serve structural load or long-term window stability purposes. Another advantage of the present assemblies and methods involves providing the option to an installer to insert fasteners anywhere (in some examples) along a full length of the frame members to deal with bowed jambs and proper securement. Yet another advantage provided by the present assemblies and methods is that additional parts are not required to add this adjustability and securing feature to a window or door assembly as it may be built into the jamb liner or the jamb member.

These and other examples, aspects, advantages, and features of the present assemblies and methods will be set forth in part in the detailed description, which follows, and in part will become apparent to those skilled in the art by reference to the following description of the present assemblies, methods, and drawings or by practice of the same.

BRIEF DESCRIPTION OF THE DRAWINGS

In the drawings, which are not necessarily drawn to scale, like numerals describe similar components throughout the several views. The drawings illustrate generally, by way of example, but not by way of limitation, various embodiments discussed in this patent document.

DETAILED DESCRIPTION

The following detailed description includes references to the accompanying drawings, which form a part of the detailed description. The drawings show, by way of illustration, specific embodiments in which the present assemblies and methods may be practiced. These embodiments, which are also referred to herein as "examples," are described in enough detail to enable those skilled in the art to practice the present assemblies and methods. The embodiments may be combined or varied, other embodiments may be utilized or structural or logical changes may be made without departing from the scope of the present assemblies and methods. It is also to be understood that the various embodiments of the present assemblies and methods, although different, are not necessarily mutually exclusive. For example, a particular feature, structure or characteristic described in one embodiment may be included within other embodiments. The following detailed description is therefore, not to be taken in a limiting sense, and the scope of the present assemblies and methods are defined by the appended claims and their equivalents.

In this document: the terms "a" or "an" are used to include one or more than one; the term "or" is used to refer to a nonexclusive or, unless otherwise indicated; and the term "fastener" is used to include, but is not limited to, both right- and left-handed fasteners; however, for clarity purposes right-handed fasteners will be discussed herein (noteworthy is that for left-handed fasteners, opposite rotation as that discussed, is needed to effectuate similar translative movement). It is to be understood that the phraseology or terminology employed herein, and not otherwise defined, is for the purpose of description only and not of limitation.

Assemblies and methods are provided herein for shim-less positioning of a window or door frame within an adjacent supporting framework without any additional parts (as this adjustability feature is built into a window or door assembly, such as a jamb member or jamb liner coupled to the jamb member). The assemblies and methods further provide an installer with the ability to insert fasteners anywhere (in some examples) along a full length of the frame members to deal with bowed jambs and proper securement. It should be noted that once the window or door is properly positioned using the fasteners, one or more spacers may be inserted between adjacent frame and rough opening members, if necessary, and the fasteners tightened thereafter.

Figure 1A:
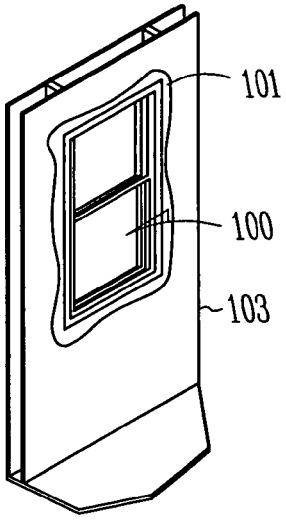
FIG. 1A is a perspective view of a window and an environment in which the window may be used, as constructed in accordance with at least one embodiment.

FIG. 1A is a perspective view of at least one example of a double or single hung window 100 and an environment in which window 100 may be used. In this example, window 100 is mounted in a rough opening 101 of a wall 103 in a building or other structure. Rough opening 101 must be large enough so that window 100 may be slipped into place and thereafter adjusted vertically 105 (FIG. 1B) or horizontally 107 (FIG. 1B) as needed to establish a plumb and square orientation.

Figure 1B:
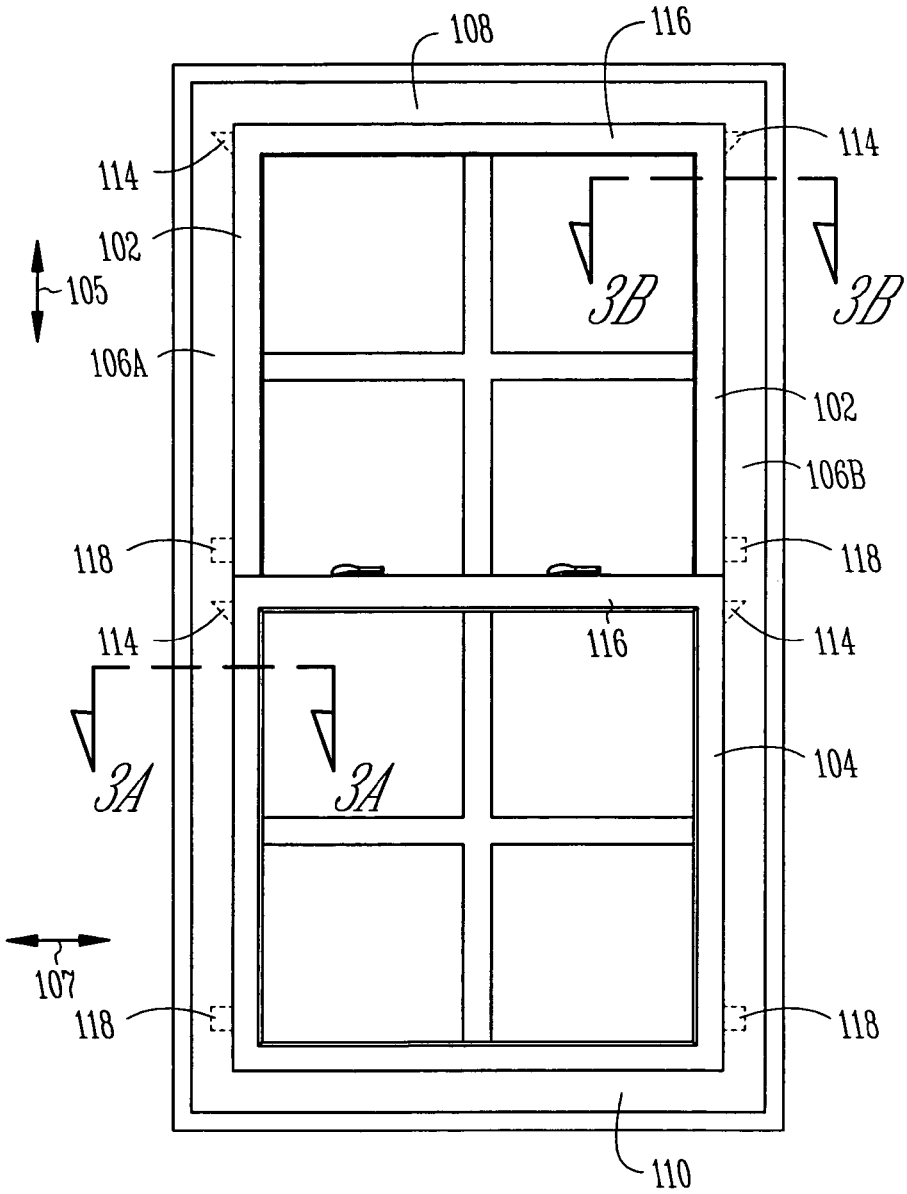
FIG. 1B is a frontal view of a window, as constructed in accordance with at least one embodiment.

FIG. 1B is a frontal view of window 100 of FIG. 1A. In this example, window 100 includes an upper sash 102 and a lower sash 104, which are supported by opposing side jambs 106A, B, a head jamb 108, and a sill 110. Head jamb 108 is positioned at top and is flanked on each side by side jambs 106A, B. Sill 110 is located opposite head jamb 108. In one example, lower sash 104 is sized and shaped to slide vertically along side jambs 106A-B. In another example, upper and lower sashes 102, 104 (respectively) are sized and shaped to slide vertically along side jambs 106A, B. In yet another example, upper sash 102 is disposed toward an exterior of window 100 (e.g., closer to an outdoor environment), while the lower sash 104 is disposed toward an interior of window 100 (closer to an indoor environment).

Figure 2:
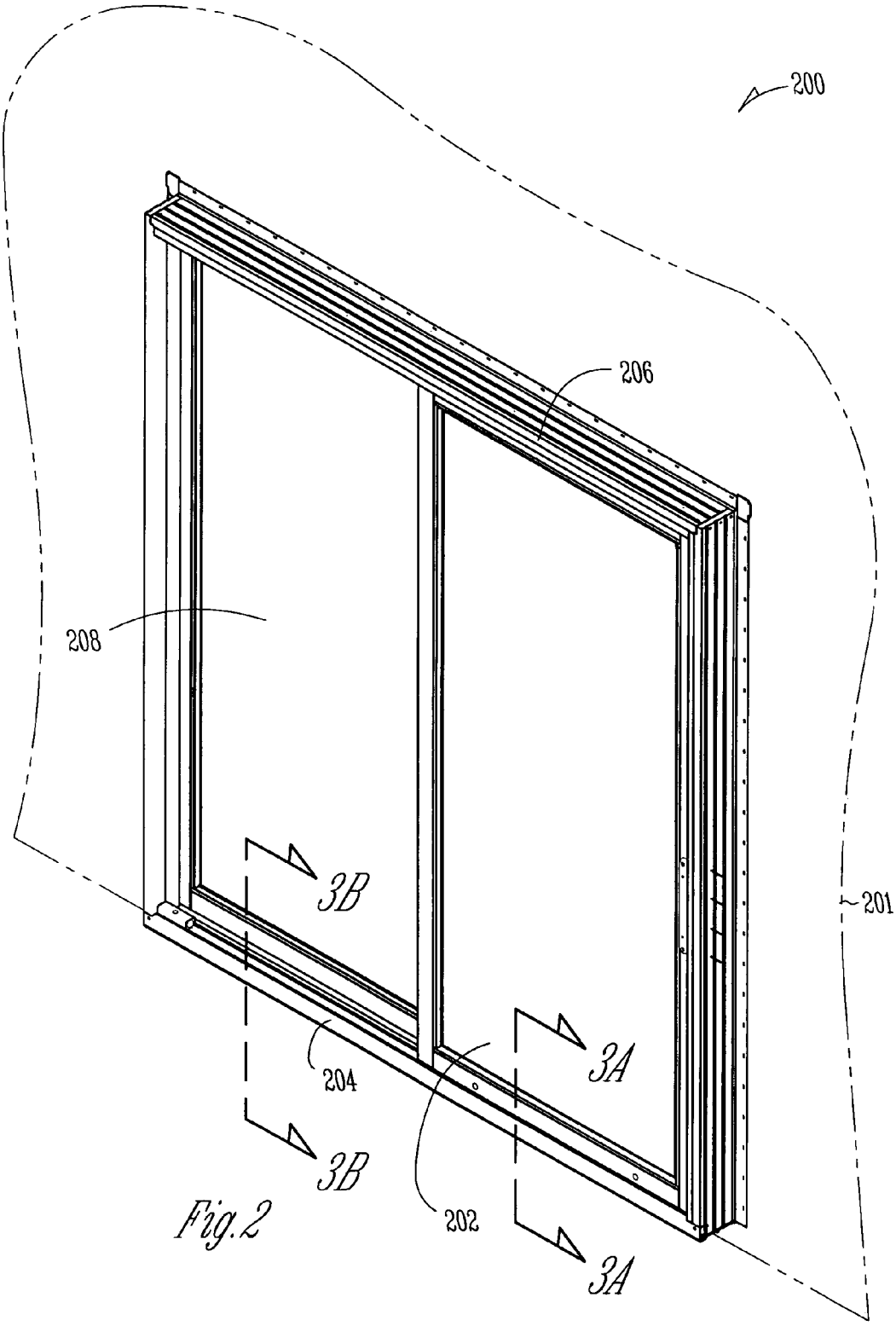
FIG. 2 is a perspective view of a door and an environment in which the door may be used, as constructed in accordance with at least one embodiment.

FIG. 2 is a perspective view of a door 200 and an environment in which door 200 may be used. In this example, door 200 is mounted in a rough opening 201, which (as stated above in reference to FIG. 1A) must be large enough so that door 200 may be slipped into place and thereafter adjusted vertically 105 (FIG. 1B) or horizontally 107 (FIG. 1B) as needed to establish a plumb and square orientation. Typically, rough opening 201 or 101 in wall 103 (FIG. 1A) is formed by one or more wall studs and a header (although the framing of interior walls does not always require a header). In one example, door 200 includes at least one sash, such as a sliding door 202 sized and shaped to slide horizontally 107 (FIG. 1B) along a sill 204 and a head jamb 206 (e.g., sill 204 and head jamb 206 function similar to side jambs 106A, B shown in FIG. 1B). In another example, door 200 includes a second sliding door 208 sized and shaped to slide along sill 204 and head jamb 206. In yet another example, window 100 (FIG. 1B) includes sashes sized and shaped to slide horizontally in a similar manner to sliding doors 202, 208 (described above).

Figure 3A:
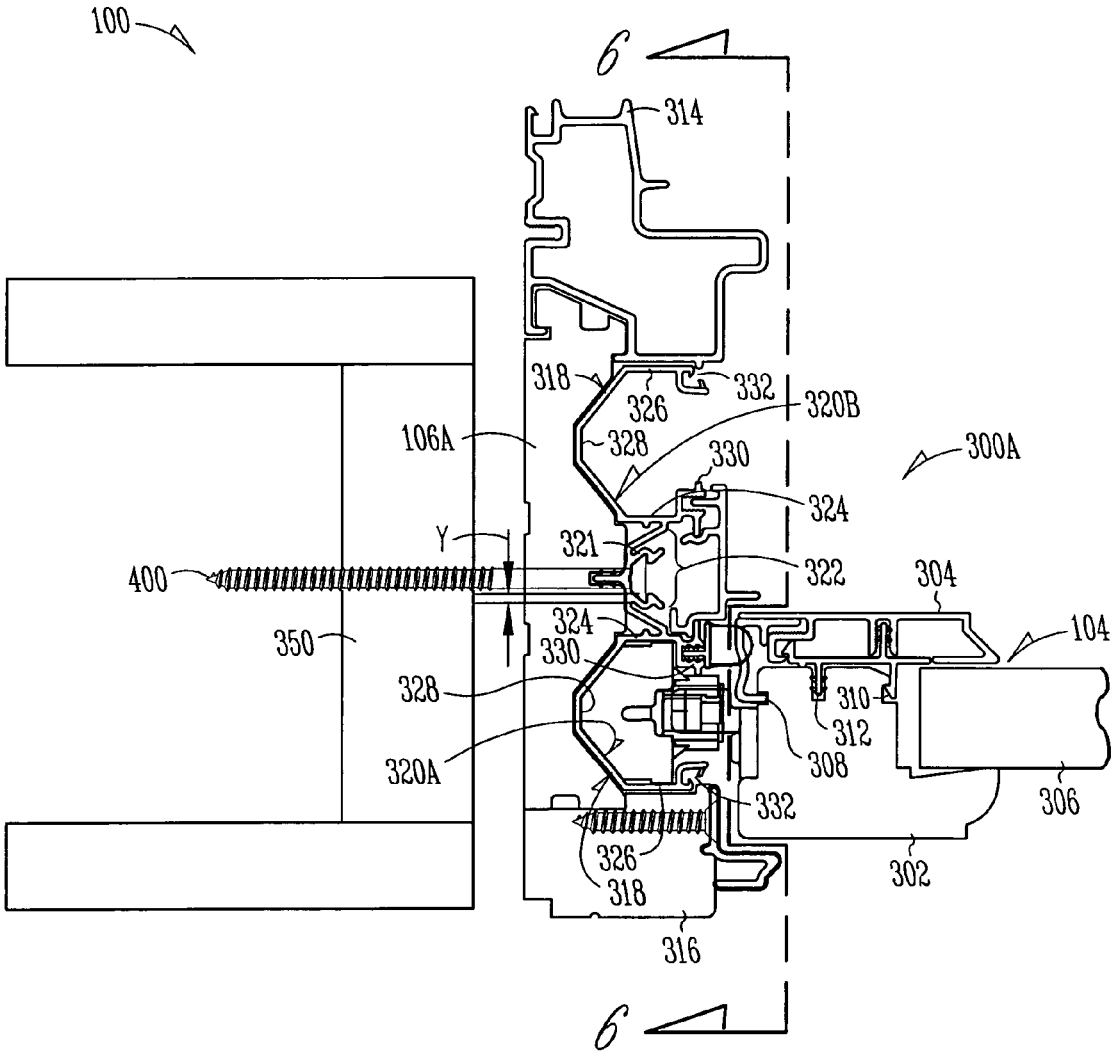
FIG. 3A is a sectional view taken along line 3A-3A of FIG. 1B illustrating a lower portion of a window jamb assembly, as constructed in accordance with at least one embodiment.
Figure 3B:
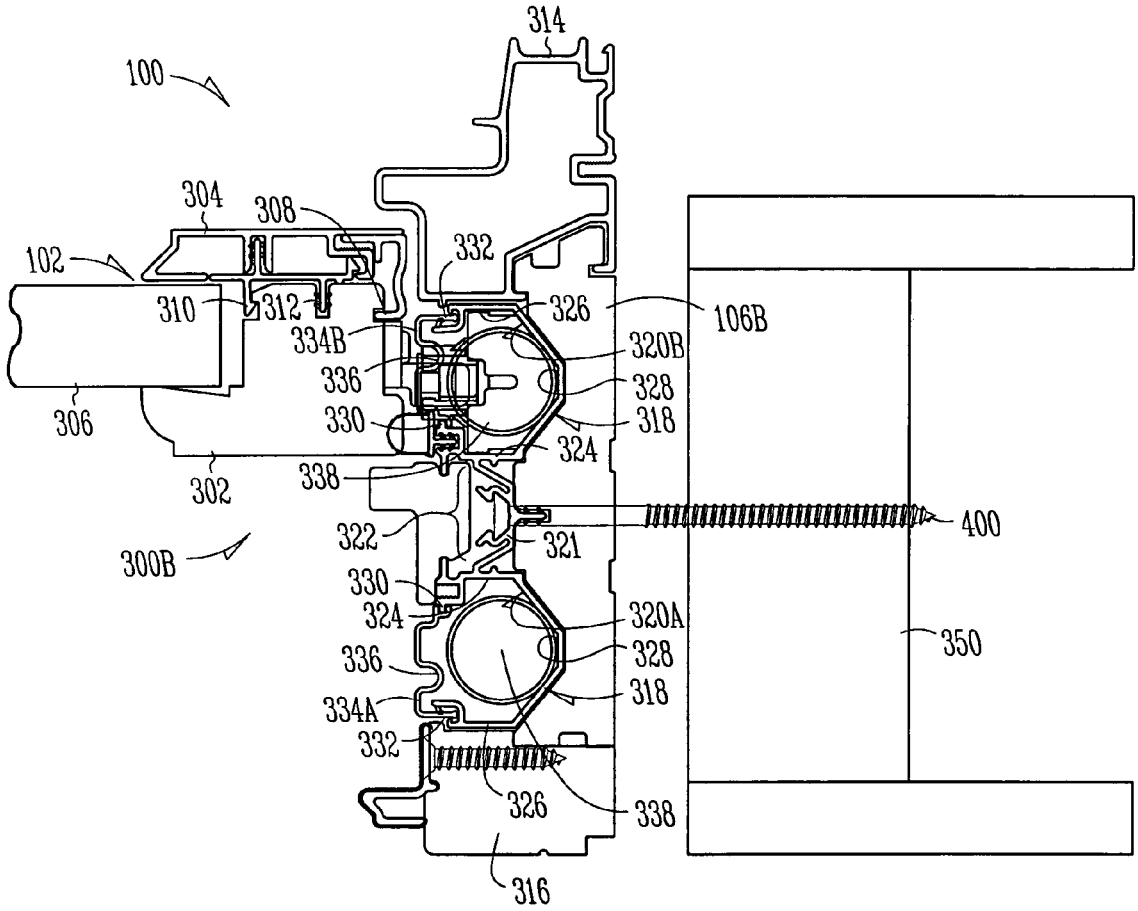
FIG. 3B is a sectional view taken along line 3B-3B of FIG. 1B illustrating an upper portion of a window jamb assembly, as constructed in accordance with at least one embodiment.

FIGS. 3A, 3B are sectional views taken along line 3A-3A, 3B-3B (respectively) of window 100 shown in FIG. 1B. FIG. 3A illustrates a lower portion of a window jamb assembly 300A (including side jamb 106A), while FIG. 3B illustrates an upper portion of a window jamb assembly 300B (including side jamb 106B). Notable at this time is that door 200 may include one or more jamb assemblies similar to that which are discussed below.

As shown in FIGS. 3A, 3B, upper and lower sashes 102, 104 (respectively) of window 100 (FIG. 1B) are slidably coupled along window jamb assemblies 300A, 300B. In these examples, upper and lower sashes 102, 104 include a stile 302 and a stile cladding 304. In one example, stile cladding 304 is formed of a polymer such as polyvinyl chloride; however, the present subject matter is not so limited. In another example, stile cladding 304 is formed of a metal, such as aluminum, or other suitable material. In another example, stile cladding 304 is formed by an extrusion, pultrusion, molding, or machining process. In yet another example, upper and lower sashes 102, 104 include stile 302 coupled with a stile trim piece formed of wood. A glass pane 306 is retained within upper and lower sashes 102, 104 by coupling glass pane 306 between stile 302 and stile cladding 304. In a further example, stile cladding 304 is coupled to stile 302 with one or more hooks 308, catches 310, or barbed flanges 312. In still other examples, stile cladding 304 is coupled to stile 302 via adhesives, such as double-sided tape. In a similar fashion, glass pane 306 may be coupled between stile 302 and the stile trim piece.

In the examples of FIGS. 3A, 3B, a jamb cladding 314 is coupled along side jambs 106A, B near the exterior of the window 100. Similar to stile cladding 304, jamb cladding 314 may be constructed with polymers, such as polyvinyl chloride, metals, such as aluminum, in addition to wood. As shown, a jamb interior liner 316 is coupled along side jambs 106A, B near the interior of window 100. In one example, jamb interior liner 316 is formed of wood, but it is not limited thereto. As discussed above (in reference to stile cladding 304), jamb interior liner 316 and jamb cladding 314 may be coupled to side jambs 106A, B using one or more hooks, catches, barbed flanges, adhesives, or the like.

Figure 6:
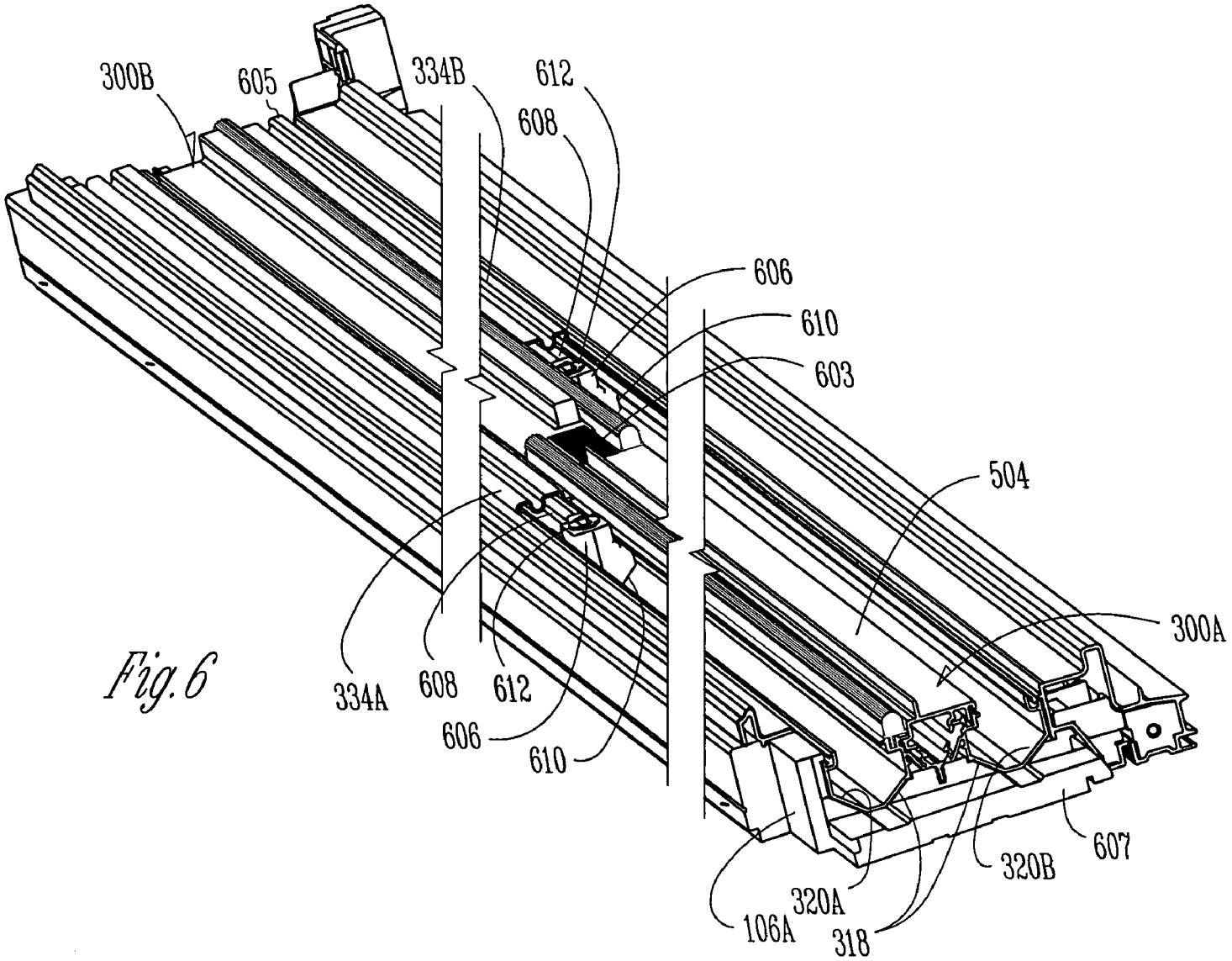
FIG. 6 is a fragmented front elevational view taken along line 6-6 of FIG. 3A illustrating portions of a window jamb assembly, as constructed in accordance with at least one embodiment.

In the examples of FIGS. 3A, 3B, and 6, window jamb assemblies 300A, 300B include one or more jamb liners 318 extending along at least a portion of side jambs 106A, B between sill 110 (FIG. 1B) and head jamb 108 (FIG. 1B). In one example, jamb liners 318 extend the entire length of side jambs 106A, B. As shown in FIG. 6, window jamb assembly 300A includes jamb liners 318, which extend from a location 607 (e.g., where sill 110 couples with side jamb 106A) to a location 605 (e.g., where head jamb 108 couples with side jamb 106A). Jamb liners 318 may be formed with, but are not limited to, metals, such as aluminum, or polymers such as polyvinyl chloride. In another example, jamb liners 318 are formed by extruding a semi-molten material through a die having a cross sectional geometry of jamb liner 318 thereby creating lineal sections of the same. In yet another example, jamb liners 318 are formed by a pultrusion, molding, or machining process. In still another example, jamb liners 318 are integrated with side jambs 106A, B.

As shown in FIGS. 3A, 3B, jamb liners 318 of window jamb assemblies 300A, 300B include one or more balance channels 320A, B spaced apart by a web 322 including a retaining member 321 extending therebetween. In one example, balance channels 320A, B have a (generally) U-shaped geometry and include an inner wall section 324 and an outer wall section 326 joined by a rear wall section 328. In another example, balance channels 320A, B include one or more channel guide tabs 330 and channel guide recesses 332 sized and shaped to couple one or more balance covers 334A, B with balance channels 320A, B. One or more channel guides 336 extend along balance covers 334A, B. Channels 336 are sized and shaped to receive a blade member 114 (FIG. 1B) extending from at least one of upper or lower sashes 102, 104 (respectively). Balance covers 334A, B and blade member 114 slidably couple upper and lower sashes 102, 104 with side jambs 106A, B and permit movement of such sashes along the same. Additionally, blade members 114 received in channels 336 of balance covers 334A, B constrain lateral movement of upper and lower sashes 102, 104 (e.g., movement in and out of a plane defined by window 100) at the point of contact between blade members 114 and balance covers 334A, B.

As shown in FIG. 3B, balance covers 334A, B are coupled with balance channels 320A, B of window jamb assembly 300B. Because blade members 114 may optionally extend from one or more upper rails 116 (FIG. 1B) of upper and lower sashes 102, 104 (respectively), balance covers 334A, B extend along side jambs 106A, B according to a range of travel of blade members 114. As shown in FIG. 6, balance cover 334A extends along jamb liners 318 to a location just below a check rail position 603, because blade member 114 of lower sash 104 has a range of travel between head jamb 108 and an area just below check rail position 603 (e.g., where blade member of lower sash 104 rests when the same is in a closed position, as shown in FIG. 1B). Balance cover 334B extends along jamb liner 318 to a location just above check rail position 603, because blade member 114 of upper sash 102 has a range of travel between head jamb 108 and the area just above check rail position 603 (e.g., where blade member 114 of upper sash 102 rests when the same is in a substantially open position).

Referring again to FIG. 3B, balance channels 320A, B include one or more balance tubes 338 sized and shaped to fit within balance channels 320A, B when balance covers 334A, B are coupled with their respective balance channels. In one example, each balance tube 338 includes a biasing mechanism (e.g., one or more springs, elastomers, or the like) coupled with one of upper or lower sashes 102, 104 (respectively). Balance tubes 338 substantially counterbalance a weight of upper and lower sashes 102, 104 and facilitate movement of the sashes along side jambs 106A, B. In another example, balance tubes 338 are carried in balance channels 320A, B of each side jamb 106A, B on both sides of upper and lower sashes 102, 104 (e.g., a balance tube 338 is located in each balance channel on either side of each sash).

Referring now to FIG. 6, balance tubes 338 are sized and shaped to be coupled to upper and lower sashes 102, 104 (respectively) with one or more clutches 606 and flexible elements 608 extending between balance tubes 338 and the clutches. Clutches 606 are sized and shaped to slidably couple with balance channels 320A, B and transmit the counterbalancing force of balance tubes 338 to upper and lower sashes 102, 104. Clutches 606 include an exterior geometry 610 corresponding to a geometry of balance channels 320A, B. Clutches 606 are thereby substantially constrained from lateral movement within balance channels 320A, B. As shown in FIG. 1B, each sash includes one or more tilt pins 118 sized and shaped to couple with clutches 606. Clutches 606 further include pin recesses 612 to receive tilt pins 118. Tilt pins 118 cooperate with blade members 114 to retain upper and lower sashes 102, 104 within window jamb assemblies 300A, 300B and constrain lateral movement of the sashes at the points of contact between blade members 114 and balance covers 334A, 334B and between tilt pins 118 and clutches 606.

In one example, at least one of upper and lower sashes 102, 104 (respectively) are tilted around tilt pins 118 to move the sashes out of window jamb assemblies 300A, 300B for cleaning, replacement, repair, or the like. In another example, blade members 114 for each sash 102, 104 are pulled out of channels 336 of balance covers 334A, 334B to permit rotation of such sashes out of window jamb assemblies 300A, 300B. In yet another example, as upper and lower sashes 102, 104 are rotated, tilt pins 118 rotate an anchor feature of each clutch 606 into engagement with balance channels 320A, B. As sashes 102, 104 are removed from window jamb assemblies 300A, 300B, anchor features retain clutches 606 at their last location along balance channels 320A, B to facilitate easy coupling of the sashes thereon.

Figure 4A:
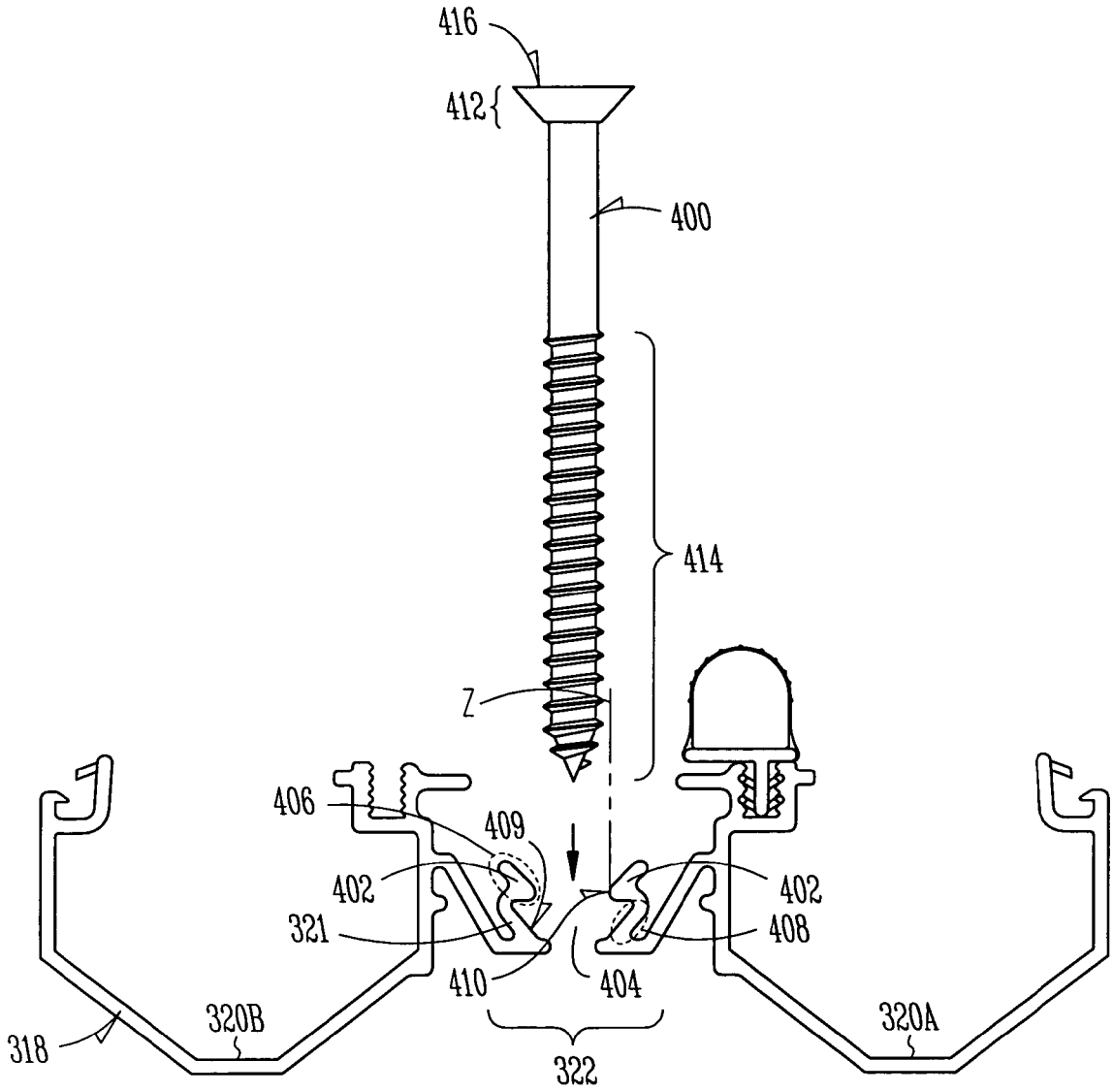
FIG. 4A is a sectional view taken along line 3A-3A of FIG. 1B illustrating portions of a window jamb assembly, as constructed in accordance with at least one embodiment.

FIG. 4A is a sectional view taken along line 3A-3A of FIG. 1B illustrating portions of a window jamb assembly 300A, 300B, such as jamb liner 318, in addition to fastener 400. As discussed above, jamb liner 318 may include one or more balance channels 320A, 320B spaced apart by a web 322 including a retaining member 321. Retaining member 321 is sized and shaped to receive and engage fastener 400, which includes a fastener head 412 and threaded shank 414, therein. In this way, the trueing of window 100 or door 200 (e.g., head jamb 108, side jambs 106A, 106B, and sill 110) within rough opening 101 or 201 may be accomplished by simple rotation of fastener 400 in a clockwise or a counterclockwise direction, as further discussed below.

As shown, retaining member 321 includes at least one flange 402 and a groove 404, which is formed (at least in part) by the at least one flange 402. In one example, the at least one flange 402 longitudinally extends along a portion of side jambs 106A, B. In another example, the at least one flange 402 longitudinally extends along a substantial portion of side jambs 106A, B, such as the full length of the jambs (see, e.g., FIG. 6). The longitudinal length of the at least one flange 402 advantageously allows a (window or door) installer to insert fasteners in a plurality of locations on window or door frame members (e.g., side jambs 106A, B). This flexibility as to where fasteners may be inserted is important when dealing with the installation of one or more bowed jambs.

In another example, the at least one flange 402 includes both an entry portion 406 and an engagement portion 408. In such an example, entry portion 406 is sized and shape to facilitate insertion of fastener 400 into retaining member 321, while the engagement portion 408 is sized and shaped to retain fastener 400, specifically a fastener head 412, after it has been fully seated within retaining member 321. In another example, retaining member 321 is formed of a resilient material, such that after fastener 400 is driven through entry portion 406, a front edge 410 of the at least one flange 402 may return to resting position Z. In the example shown, it is at position Z that front edge 410 "snaps" over a top surface 416 of fastener head 412 in an overlapping fashion (see, e.g., FIG. 4B). In yet another example, groove 404 includes a shape 409 sized to matably seat fastener head 412 when top surface 416 of fastener head 412 advances past engagement front edge 410 of the at least one flange 402.

After fastener head 412 snaps into retaining member 321, fastener 400 may be rotated to adjust a position of window or door frame members (e.g., head jamb 108, side jambs 106A, B, and sill 110) within rough opening 101 or 201 and secure such frame members to an adjacent inner surface 350 (FIGS. 3A, 3B) of rough opening 101 or 201. Notably, securing of the frame members to adjacent inner surface(s) 350 may occur in some examples after one or more spacers 426 (see FIG. 4E) have been inserted therebetween for structural support or long-term window stability. The cooperative arrangement of retaining member 321 and fastener 400 allows the installer to position a window or door frame without the (cumbersome) use of shims (or other spacers) and without the use of additional mounting parts. The latter results from the fact that retaining member 321 may be built into window jamb assembly 300A, 300B, such as side jambs 106A, B or jamb liner 318, the latter of which is shown in FIG. 4A. Eliminating the need for shims or other spacers during the positioning phase of a window or door installation saves the installer valuable time, particularly when installing a plurality of windows and doors.

Figure 4B:
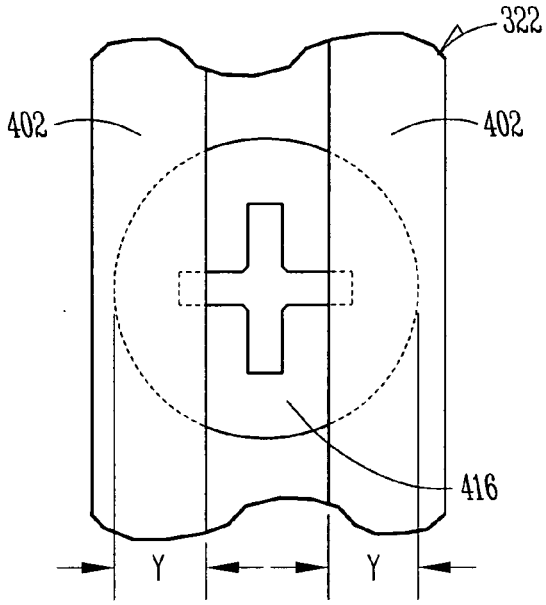
FIG. 4B is a top elevational view of portion 322 of FIG. 4A illustrating an overlapping relationship included in a window or doorjamb assembly, as constructed in accordance with at least one embodiment.

FIG. 4B is a top elevational view of web portion 322 of FIG. 4A illustrating an overlapping relationship between the at least one flange 402 and fastener head 412, specifically top surface 416 of fastener head 412, after fastener 400 is fully inserted into retaining member 321. In this example, the at least one flange 402 overlaps top surface 416 by (an amount equaling) Y on opposing sides of such surface. Overlap Y (see also FIG. 3A) prevents fastener 400 from backing out of retaining member 321 once engagement portion 408 has been activated (e.g., front end 410 snaps over fastener head top surface 416). It is the retainment of fastener 400 within retaining member 321 that causes frame members to laterally 107 (FIG. 1B) or vertically 105 (FIG. 1B) adjust as fastener 400 is rotated in a clockwise or a counterclockwise direction.

Figure 4C:
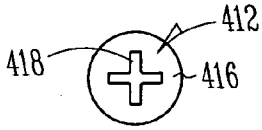
FIG. 4C is an end view of a fastener head, as constructed in accordance with at least one embodiment.
Figure 4D:
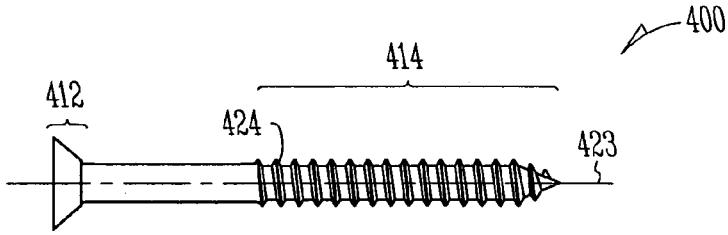
FIG. 4D is a side view of a fastener, as constructed in accordance with at least one embodiment.

FIGS. 4C, 4D illustrate one example of a fastener 400, which may be used to both adjust a position of window or door frame members within a rough opening and securing such frame members to adjacent, inner surfaces 350 of the rough opening. In particular, FIG. 4C is an end view of a fastener head 412, while FIG. 4D is a side view of fastener 400. As shown in FIG. 4C, a top surface 416 of fastener head 412 may include a geometry 418 to receive a distal end 422 of a suitable driver tool 420 (see FIG. 4E), which can be used to transmit rotational force to fastener 400. In this example, top surface 416 includes a "Phillips" geometry sized and shaped to mate with a Phillips screwdriver. In another example, top surface 416 includes a hexagonal geometry sized and shaped to mate with an "Allen" wrench of a predetermined size. Other various geometries 418 and corresponding driver tools 420 may be used to transfer external rotational force to fastener 400 without departing from the scope of the present subject matter.

As shown in FIG. 4D, fastener 400 includes a fastener head 412 portion and a threaded shank 414 portion. In one example, fastener head 412 extends radially outward from an axis 423 of threaded shank 414. In another example, one or more threads 424 of threaded shank 414 draw corresponding window or door frame members (e.g., head jamb 108, side jambs 106A, B, or sill 110) towards an adjacent inner surface 350 of a rough opening when fastener 400 (fully inserted into retaining member 321) is rotated in a clockwise direction. In yet another example, the one or more threads 424 of threaded shank 414 cause corresponding window or door frame members to move away from the adjacent inner surface 350 of the rough opening when fastener 400 (fully inserted into retaining member 321) is rotated in a counterclockwise direction. This is the result of overlap Y (FIG. 4B) of at least one flange 402 over fastener head top surface 416 imposing an outwardly directed force on the corresponding frame member. In a further example, fastener 400 is a flat-head screw; however, other fasteners 400 may also be used without departing from the scope of the present subject matter.

Figure 4E:
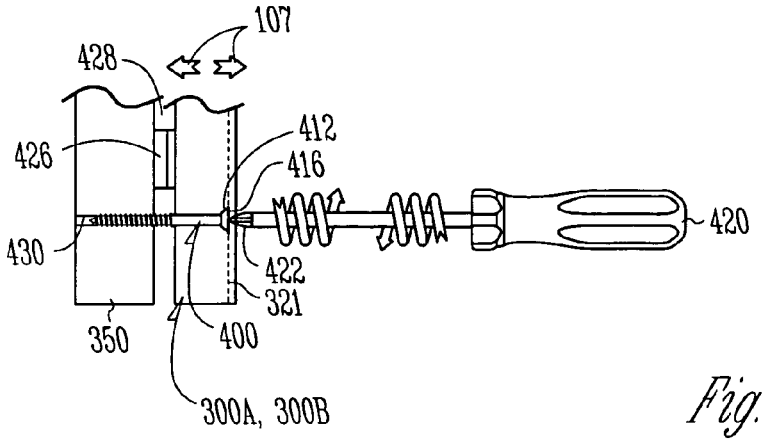
FIG. 4E is an operational view of a window or doorjamb assembly, as constructed in accordance with at least one embodiment.

FIG. 4E is an operational view of a window jamb assembly 300A, 300B including a retaining member 321 engaged with a fastener 400. As discussed above, after a top surface 416 of a fastener head 412 snaps into retaining member 321, rotation of fastener 400 may be use to adjust a (horizontal 107 or vertical 105 (FIG. 1B)) position of a window or door frame within a rough opening. In one example, fastener 400 includes a threaded shank 414 (FIG. 4D), which is mountable in threaded engagement with an adjacent inner surface 350 of the rough opening to provide adjustment and maintenance of a spacing or clearance 428 between window jamb assembly 300A, 300B and inner surface 350. In another example, one or more spacers 426 (e.g., wood, plastic, or horseshoe shims) may be inserted within spacing 428 as soon as a desired position of a window or door frame is achieved. In a further example, a pilot hole 430 may be drilled prior to inserting fastener 400 into retaining member 321 and subsequently inner surface 350.

Figure 5:
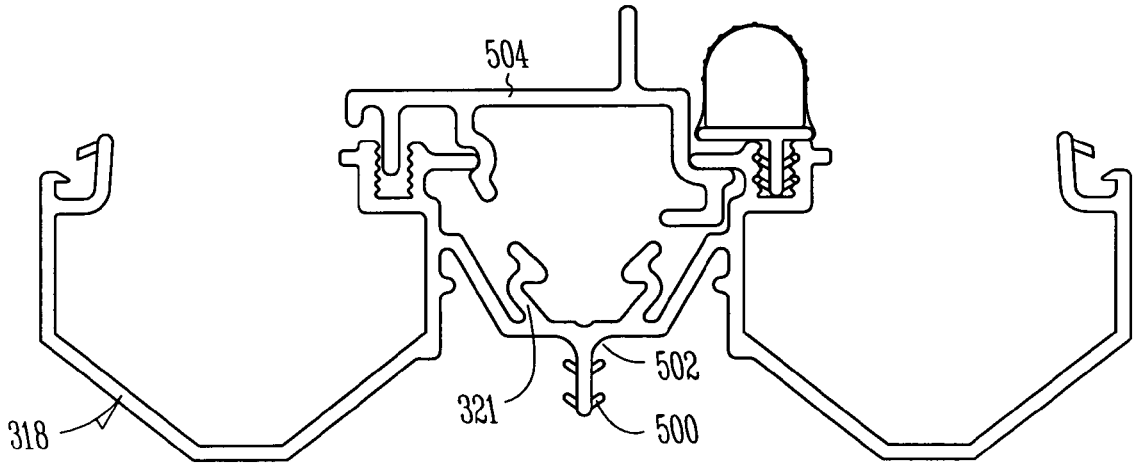
FIG. 5 is a sectional view taken along line 3A-3A of FIG. 1B illustrating portions of a window jamb assembly, as constructed in accordance with at least one embodiment.

FIG. 5 is a sectional view taken along line 3A-3A of FIG. 1B illustrating portions of a window jamb assembly 300A, 300B, such as a jamb liner 318 including a retaining member 321. In one example, retaining member 321 is formed of a material selected from a group consisting of a metal and a polymer. In one such example, retaining member 321 is formed of a polymer, such as polyvinyl chloride. In another example, retaining member 321 is formed of a metal, such as aluminum. In yet another example, retaining member 321 is formed by an extrusion, pultrusion, molding, or machining process, such as by being extruded with jamb liner 318 or jamb member 106A, B. In another example, retaining member 321 is coupled with jamb liner 318 or jamb member 106A, B. In a further example, a barbed flange 500 is coupled to an outlet end 502 of retaining member 321. Barbed flange 500 is sized and shaped to allow a fastener 400 to be inserted therethrough at locations chosen by an installer (i.e., barbed flange 500 is pierceable). Referring again to FIG. 6, a partial cross-section of which is shown in FIG. 5, window jamb assembly 300A, 300B may be adapted to be coupled with a structural filler 504. In one example, a structural filler 504 is couplable to a jamb liner 318 of window jamb assembly 300A, 300B is disclosed in another U.S. patent application entitled, "STRUCTURAL FILLER SYSTEM FOR A WINDOW OR DOOR," Ser. No. 11/127,985, filed on May 12,2005, which is hereby incorporated by reference in its entirety.

Figure 7:
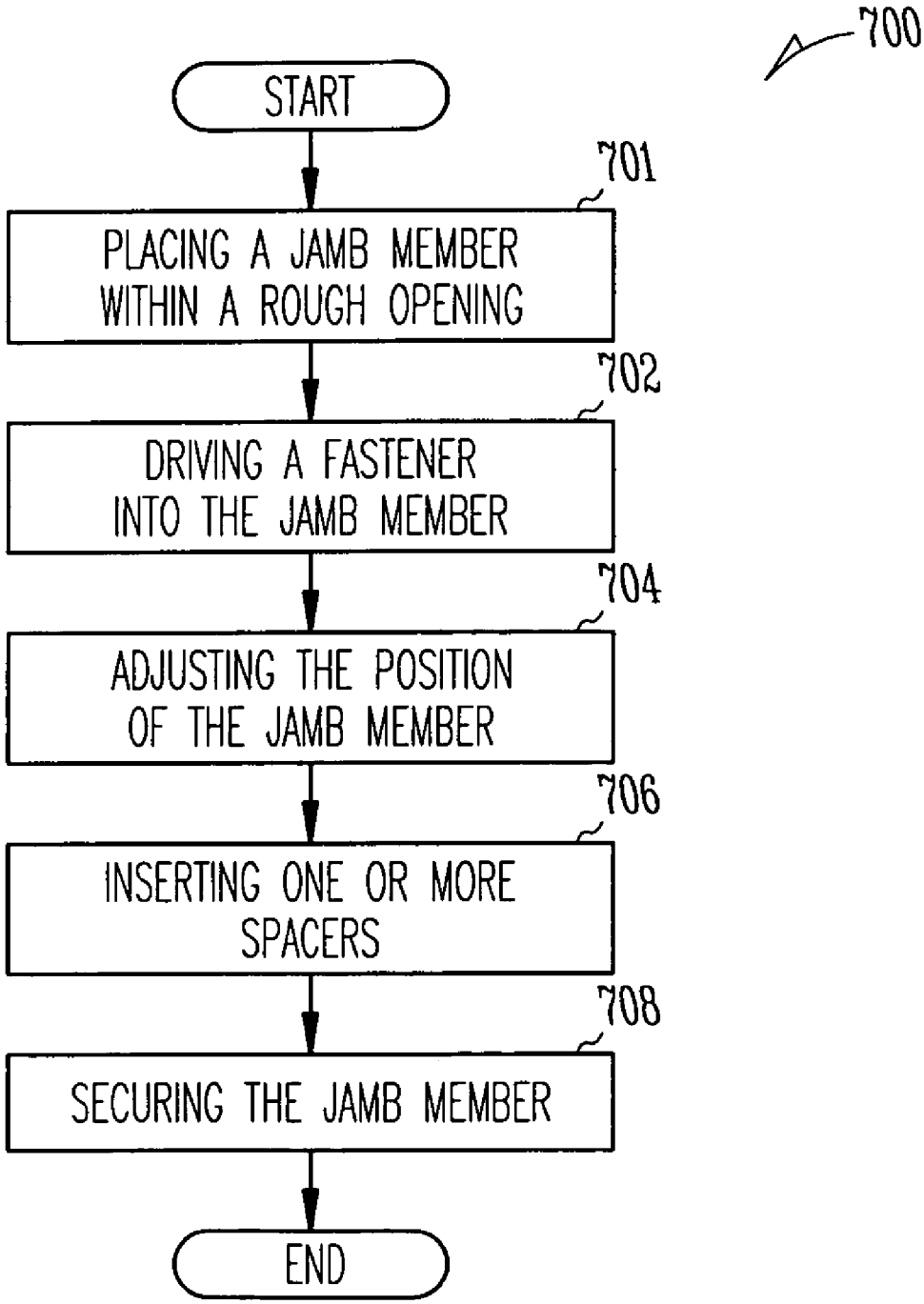
FIG. 7 is a flow diagram illustrating a method for installing a window or door, as constructed in accordance with at least one embodiment.

FIG. 7 is a flow diagram illustrating a method 700 for installing a window or a door having a jamb assembly including a retaining member. At 701, a jamb member (e.g., a window or door frame member) is placed within a rough opening in a wall of a building or other structure such that the jamb member is adjacent to an inner surface of the rough opening. At 702, a fastener (e.g., flat-head screw) is driven into the jamb member. In one example, driving the fastener into the jamb member includes engaging a top surface of a fastener head with at least one flange of the retaining member. In another example, driving the fastener into the jamb member includes fully seating the fastener head within the retaining member and inserting a threaded shank of the fastener into the inner surface of the rough opening.

At 704, the position of the jamb member relative to the inner surface of the rough opening is adjusted. In one example, adjusting the position of the jamb member includes selectively rotating the fastener (engaged with the retaining member) in a clockwise or a counterclockwise direction. In one such example, the rotation of the fastener in a clockwise direction affects movement of the jamb member in a direction of the adjacent inner surface of the rough opening. In another such example, rotation of the fastener in a counterclockwise direction affects movement of the jamb member away from the adjacent inner surface of the rough opening. The departing position of the jamb member relative to the adjacent inner surface is made possible by an overlapping of at least one flange (of the present assemblies and methods) of a top surface of the fastener head when the fastener head is fully seated in a groove. In another example, adjusting the position of the jamb member includes positioning the jamb member until a plumb and square orientation (relative to adjacent and opposing jamb members) or removing one or more bows from the jamb member is achieved. In still another example, adjusting the position of the jamb member includes squaring the window or door frame (e.g., by taking diagonal measurement of the frame assembly).

At 706, one or more spacers are inserted between the jamb member and the inner surface of the rough opening, if necessary. In one example, the one or more spacers include one or more wood or plastic shims. After it is determined by an installer that the window or door frame being installed is plumb and square (e.g., at a desired position between the inner surfaces of the rough opening), spacers may be inserted to filled the gap between the jamb member and the corresponding inner surface. Adding the one or more spacers (e.g., shims) may be an important part of the structural performance or long-term position stability of the window or door.

At 708, the jamb member is secured to the inner surface of the rough opening. In one example, securing the jamb member to the inner surface of the rough opening includes rotating the fastener in substantially a clockwise direction. In another example, the fasteners are horizontally inserted through the jamb member and screwed into the adjacent inner surface of the rough opening.

A method for manufacturing a window or door assembly includes, forming a longitudinally extending retaining member sized and shaped to receive and engage a fastener at a plurality of locations therein. The retaining member includes at least one flange and a groove within the at least one flange. The method further includes coupling the retaining member with a jamb liner. Further yet, the method includes coupling the retaining member and the jamb liner with a jamb member. Several options for manufacturing the window or door assembly are as follows. In one example, forming the at least one flange includes forming an entry portion sized and shaped to facilitate insertion of the fastener into the retaining member. In another example, forming the at least one flange includes forming an engagement portion sized and shaped to overlap a top surface of a fastener head when the fastener head is fully seated in the groove. In yet another example, forming the groove includes forming a shape sized to matably seat the fastener head when the top surface of the fastener head advances past the engagement portion of the at least one flange. In a further example, coupling the retaining member includes extruding the retaining member with the jamb liner.

The present assemblies and methods provide numerous advantages for an installer. As one example, the present assemblies and methods provide a (window or door) frame mounting scheme that does not rely on the use of spacers, such as shims, for proper positioning of the frame (e.g., head jamb, side jambs, or sill) within a rough opening in a wall. Rather the present assemblies and methods allow for adjustably positioning the frame within the rough opening by simple rotation of at least one fastener engaged with a retaining member, thereby saving the installer time and effort. This shim-less adjusting also simplifies the installation process allowing a novice (in the field of carpentry) to install a window or door with minimal difficulty. It is only after the window or door is properly positioned within the rough opening that one or more spacers may need to be inserted between adjacent frame and rough opening members. The insertion of the one or more spacers at such a stage in the installation process may serve structural load or long-term window stability purposes. Another advantage of the present assemblies and methods involves providing the option to an installer to insert fasteners anywhere (in some examples) along a full length of the frame members to deal with bowed jambs and proper securement. Yet another advantage provided by the present assemblies and methods is that additional parts are not required to add this adjustability and securing feature to a window or door assembly as it may be built into the jamb liner or the jamb member.

As mentioned above, this Detailed Description is not to be taken in a limiting sense, and the scope of various embodiments is defined only by the appended claims, along with the full range of legal equivalents to which such claims are entitled. In the appended claims, the term "including" is used as the plain-English equivalent of the term "comprising." Also in the following claims, the terms "including" and "comprising" are open-ended, that is, a system, device, article, or process that includes elements in addition to those listed after such a term in a claim are still deemed to fall within the scope of that claim.

What is claimed is:

1. A window or door assembly, comprising:

a jamb member;

a jamb liner coupled with the jamb member, the jamb liner including a retaining member sized and shaped to receive and engage at least a portion of a fastener therein, the retaining member including, at least one flange along a portion of the jamb liner; and a groove formed within the retaining member, the at least one flange extending partially over the groove;

where the fastener is in a seated orientation within the groove;

the flange extends partially over a fastener head and substantially prevents the fastener from backing out of the retaining member, and the fastener is engaged with the retaining member and retains the jamb liner along the jamb member where the flange extends partially over the fastener head.

2. The window or door assembly as recited in claim 1, wherein the at least one flange includes, an entry portion sized and shaped to facilitate insertion of the fastener into the groove; and an engagement portion sized, shaped, and oriented to retain the fastener after a fastener head is fully inserted into the groove.

3. The window or door assembly as recited in claim 1, wherein the retaining member longitudinally extends along a substantial portion of the jamb member.

4. The window or door assembly as recited in claim 1, wherein the retaining member is formed of a resilient material.

5. The window or door assembly as recited in claim 1, wherein the retaining member is extruded with the jamb liner.

6. The window or door assembly as recited in claim 1, wherein the retaining member is formed of a material selected from a group consisting of a metal and a polymer.

7. The window or door assembly as recited in claim 1, wherein the jamb member and the jamb liner are integral and formed of a single material.

8. A window or door assembly attachable to an adjacent supporting frame, comprising:

at least one fastener having a longitudinal axis and a fastener head;

a fastener receiving retaining member longitudinally extending substantially perpendicular to an insertion angle of the longitudinal axis, the retaining member including a flange, and a portion of the retaining member forms a groove longitudinally extending along a substantial portion of the retaining member and engagable with a portion of the at least one fastener; and in a seated orientation where the fastener head is seated within the groove and the flange partially extends over the fastener head axial movement of the at least one fastener toward and away from the adjacent supporting frame causes corresponding localized movement of the retaining member near the fastener toward and away from the adjacent supporting frame.

9. The window or door assembly as recited in claim 8, wherein the groove includes a converging cross-sectional shape substantially contacting with a ramped underside portion of the fastener head.

10. The window or door assembly as recited in claim 8, wherein the at least one flange includes a ramped entry portion facilitating insertion of the at least one fastener into the groove.

11. The window or door assembly as recited in claim 8, wherein the at least one flange includes a fastener engagement portion sized, shaped, and oriented to overlap a top surface of a received fastener head.

12. The window or door assembly as recited in claim 11, wherein axial movement of the at least one fastener in a first direction away from the adjacent supporting frame presses a top surface of a received fastener head against the fastener engagement portion.

13. The window or door assembly as recited in claim 12, wherein axial movement of the at least one fastener in a second direction opposite the first direction presses a ramped portion of the received fastener head against a portion of the groove.

14. The window or door assembly as recited in claim 8, further comprising a jamb liner coupled to or integrated with the retaining member.

15. The window or door assembly as recited in claim 14, further comprising a jamb member coupled with the jamb liner.

16. A window or door assembly, comprising:

at least one fastener including a fastener head and a threaded shank;

a jamb liner including a retaining member sized and shaped to resiliently receive the fastener head in a seated orientation, and in the seated orientation:

the retaining member overlappingly extends over and under the fastener head at a plurality of locations in a groove extending along a length of the retaining member, and the fastener is immobilized against longitudinal movement relative to the retaining member while the retaining member extends over and under the fastener head;

and a jamb member coupled along the jamb liner by the fastener coupled therebetween, the jamb liner is fixed along the jamb member by the fastener head held in the retaining member in the seated orientation.

17. The window or door assembly of claim 16, wherein the at least one fastener defines a longitudinal axis, the longitudinal axis received by the jamb liner substantially normal to a jamb liner defined plane.

18. The window or door assembly of claim 16, wherein a top surface of the fastener head is snap-fitted within a flange of the retaining member.

19. The window or door assembly of claim 18, wherein the top surface of the fastener head includes an activation tool insertion port, the activation tool insertion port positioned adjacent to and below a tip of the flange.

20. The window or door assembly of claim 16, wherein the at least one fastener is rotatable in a clockwise or a counterclockwise direction causing localized movement of the jamb liner relative to an adjacent supporting frame.

21. The window or door assembly of claim 20, wherein the localized movement of the jamb liner relative to the adjacent supporting frame removes one or more jamb member bows.

22. The window or door assembly of claim 16, wherein rotation of a first fastener pivots the jamb liner about a second fastener spaced apart from the first fastener.

* * * * *

UNITED STATES PATENT AND TRADEMARK OFFICE

CERTIFICATE OF CORRECTION

PATENT NO. : 7,631,465 B2
APPLICATION NO. : 11/127906
DATED : December 15, 2009
INVENTOR(S) : Daniel J. Curtis It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1085 days.

Signed and Sealed this

Twenty-first Day of December, 2010

David J. Kappos

David J. Kappos
*Director of the United States Patent and Trademark Office*